US007413032B2

(12) United States Patent
Krueger

(10) Patent No.: US 7,413,032 B2
(45) Date of Patent: Aug. 19, 2008

(54) SELF-CONTROLLED DIRECTIONAL DRILLING SYSTEMS AND METHODS

(75) Inventor: Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 116 days.

(21) Appl. No.: 10/758,309

(22) Filed: Jan. 15, 2004

(65) Prior Publication Data

US 2004/0216921 A1 Nov. 4, 2004

Related U.S. Application Data

(63) Continuation-in-part of application No. 10/334,029, filed on Dec. 30, 2002, now abandoned, which is a continuation of application No. 09/438,013, filed on Nov. 10, 1999, now Pat. No. 6,513,606.

(60) Provisional application No. 60/107,856, filed on Nov. 10, 1998.

(51) Int. Cl.
*E21B 44/00* (2006.01)
*E21B 7/04* (2006.01)
*E21B 7/06* (2006.01)

(52) U.S. Cl. ..... 175/61; 175/26; 175/45; 175/76; 166/255.2

(58) Field of Classification Search ..... 166/255.1, 166/255.2, 313, 50, 117.5, 241.6, 241.4; 175/45, 61, 107, 26, 73, 76, 325.1, 325.5
See application file for complete search history.

(56) References Cited

U.S. PATENT DOCUMENTS

| | | | | |
|---|---|---|---|---|
| 5,168,941 | A | 12/1992 | Krueger et al. | |
| 5,220,963 | A | 6/1993 | Patton | |
| 5,332,048 | A | 7/1994 | Underwood et al. | |
| 5,341,886 | A | 8/1994 | Patton | |
| 5,603,386 | A | 2/1997 | Webster | |
| 6,092,610 | A | 7/2000 | Kosmala et al. | |
| 6,213,226 | B1 * | 4/2001 | Eppink et al. | 175/61 |

FOREIGN PATENT DOCUMENTS

WO WO 98/17894 4/1998

OTHER PUBLICATIONS

Patton, "Automatic Directional Drilling Shows Promise", Petroleum Engineer International, 64, Apr. 1992, pp. 44-48.

* cited by examiner

*Primary Examiner*—Shane Bomar
(74) *Attorney, Agent, or Firm*—Madan, Mossman & Sriram, P.C.

(57) ABSTRACT

System and method of controlling a trajectory of a wellbore comprises conveying a drilling assembly in the wellbore by a rotatable tubular member. The drilling assembly includes a drill bit at an end thereof that is rotatable by a drilling motor carried by the drilling assembly. The drilling assembly has a first adjustable stabilizer and an second stabilizer spaced apart from the first adjustable stabilizer. The first adjustable stabilizer having set of ribs spaced around the stabilizer, with each rib being independently radially extendable. The position of a first center of the first adjustable stabilizer is adjusted in the wellbore relative to a second center of the second stabilizer in the wellbore for controlling the trajectory of the wellbore.

27 Claims, 5 Drawing Sheets

SELF-CONTROLLED DIRECTIONAL DRILLING SYSTEMS AND METHODS

CROSS REFERENCE TO RELATED APPLICATIONS

This application is a Continuation in Part of application Ser. No. 10/334,029 filed on Dec. 30, 2002, abandoned, which is a continuation of application Ser. No. 09/438,013 filed Nov. 10, 1999, now U.S. Pat. No. 6,513,606 which claims priority to U.S. Provisional Application Ser. No. 60/107,856 filed on Nov. 10, 1998.

BACKGROUND OF THE INVENTION

1. Field of the Invention

This invention relates generally to drill strings for drilling directional wellbores and more particularly to a self-adjusting steerable drilling system and method for drilling directional wellbores.

2. Description of the Related Art

Steerable motors comprising a drilling or mud motor with a fixed bend in a housing thereof that creates a side force on the drill bit and one or more stabilizers to position and guide the drill bit in the borehole are generally considered to be the first systems to allow predicable directional drilling. However, the compound drilling path is sometimes not smooth enough to avoid problems with the completion of the well. Also, rotating the bent assembly produces an undulated well with changing diameter, which can lead to a rough well profile and hole spiraling which subsequently might require time consuming reaming operations. Another limitation with the steerable motors is the need to stop rotation for the directional drilling section of the wellbore, which can result in poor hole cleaning and a higher equivalent circulating density at the wellbore bottom. Also, this increases the frictional forces which makes it more difficult to move the drill bit forward or downhole. It also makes the control of the tool face orientation of the motor more difficult.

The above-noted problems with the steerable drilling motor assemblies lead to the development of so called "self-controlled" or drilling systems. Such systems generally have some capability to follow a planned or predetermined drilling path and to correct for deviations from the planned path. Such self-controlled system are briefly described below. Such systems, however, enable faster, and to varying degree, a more direct and tailored response to potential deviation for directional drilling. Such systems can change the directional behavior downhole, which reduces the dog leg severity.

The so called "straight hole drilling device" ("SDD") is often used in drilling vertical holes. An SDD typically includes a straight drilling motor with a plurality of steering ribs, usually two opposite ribs each in orthogonal planes on a bearing assembly near the drill bit. Deviations from the vertical are measured by two orthogonally mounted inclination sensors. Either one or two ribs are actuated to direct the drill bit back onto the vertical course. Valves and electronics to control the actuation of the ribs are usually mounted above the drilling motor. Mud pulse or other telemetry systems are used to transmit inclination signals to the surface. The lateral deviation of boreholes from the planned course (radial displacement) achieved with such SDD systems has been nearly two orders of magnitude smaller than with the conventional assemblies. SDD systems have been used to form narrow cluster boreholes and because less tortuous boreholes are drilled by such a system, it reduces or eliminates the reaming requirements.

In the SDD systems, the drill string is not rotated, which significantly reduces the hole breakout. The advantage of drilling vertical holes with SDD systems include: (a) a less tortuous well profile; (b) less torque and drag; (c) a higher rate of penetration; (d) less material (such as fluid) consumption; (e) less environmental impact; (f) a reduced risk of stuck pipe; (g) less casing wear, and (h) less wear and damage to drilling tubulars.

An automated drilling system developed by Baker Hughes Incorporated, the assignee of this application, includes three hydraulically-operated stabilizer ribs mounted on a non-rotating sleeve close to the drill bit. The forces applied to the individual ribs are individually controlled creating a force vector. The amount and direction of the side force are kept constant independent of a potential undesired rotation of the carrier sleeve. The force vector can be pre-programmed before running into the borehole or changed during the drilling process with commands from the surface.

This system has two basic modes of operation: (i) steer mode and (ii) hold mode. In the steer mode the steering force vector is preprogrammed or reset from the surface, thus allowing to navigate the well path. In the "hold mode" values for inclination and/or azimuth are preset or adjusted via surface-to-downhole communications, thus allowing changes to the borehole direction until the target values are achieved and then keeping the well on the target course. As the amount of side force is preset, the turn radius or the equivalent build-up rate (BUR) can be smoothly adjusted to the requirements from 0 to the maximum value of 8°/100 feet for such a system.

An automated directional drilling bottomhole assembly developed by Baker Hughes Incorporated and marketed under the brand name AUTOTRAK™ has integrated formation evaluation sensors to not only allow steering to solely directional parameters, but to also take reservoir changes into account and to guide the drill bit accordingly. The automated directional drilling bottomhole assembly may be used with or without a drilling motor. Using a motor to drive the entire assembly allows a broader selection of bits and maximizes the power to the bit. With a motor application, the string rpm becomes an independent parameter. It can be optimized for sufficient hole cleaning, the least casing wear and to minimize dynamics and vibrations of the BHA, which heavily depend on the rotational string frequency.

One of the more recent development of an automated drilling system is an assembly for directional drilling on coiled tubing. This system combines several features of the SDD and the automated directional drilling bottomhole assembly, such as the AUTOTRAK™ brand system, for coiled tubing applications. This coiled tubing system allows drilling of a well path in three dimensions with the capability of a downhole adjustable BUR. The steering ribs are integrated into the bearing assembly of the drilling motor. Other steering features have been adopted from the automated directional drilling bottomhole assembly, such as AUTOTRAK™ brand, with the exception that the steering control loop is closed via the surface rather than downhole. The fast bi-directional communication via the cable inside the coil provides new opportunities for the execution of well path corrections. With the high computing power available at the surface, formation evaluation measurements can be faster processed and converted into a geosteering information and imported into the software for the optimization of directional drilling.

A coiled tubing automated drilling system is disclosed in the U.S. Ser. No. 09/015,848, assigned to the assignee of this application, the disclosure of which is incorporated herein by reference.

The steering-while-rotating drilling systems can be further enhanced through a closed loop geosteering by using the formation evaluation measurements to directly correct the deviations of the course from the planned path. A true navigation can become possible with the integration of gyro systems that withstand drilling conditions and provide the required accuracy. With further automation, the manual intervention can be reduced or totally eliminated, leaving the need to only supervise the drilling process. Both supervision and any necessary intervention can then be done from remote locations via telephone lines or satellite communication.

The trend in the oil and gas industry is to drill extended reach wells having complex well profiles. Such boreholes may have an upper vertical section extending from the surface to a predetermined depth and one or more portions thereafter which may include combinations of curved and straight sections. For efficient and proper hole forming, it is important to utilize a drill string that has full 3-D steering capability for curved sections and is also able to drill straight sections fast which are not rough or spiraled.

The present invention addresses the above-noted problems and provides a drilling system that is more effective than the currently available or known systems for drilling a variety of directional wellbores.

SUMMARY OF THE INVENTION

The present invention provides a drilling system for drilling deviated wellbores. The drilling assembly of the system contains a drill bit at the lower end of the drilling assembly. A motor provides the rotary power to the drill bit. A bearing assembly disposed between the Motor and the drill bit provides lateral and axial support to the drill shaft connected to the drill bit. A steering device provides directional control during the drilling of the wellbores. A method of controlling a trajectory of a wellbore comprises conveying a drilling assembly in the wellbore by a rotatable tubular member. The drilling assembly includes a drill bit at an end thereof that is rotatable by a drilling motor carried by the drilling assembly. The drilling assembly has a first adjustable stabilizer and a second stabilizer spaced apart from the first stabilizer. The position of a first center of the first adjustable stabilizer is adjusted in the wellbore relative to a second center of the second stabilizer in the wellbore for controlling the trajectory of the wellbore. The position of the first center relative to the second center is based at least in part upon a desired wellbore trajectory stored in a controller on the drilling assembly.

In another aspect, a system for controlling a trajectory of a wellbore comprises a drilling assembly deployed in the wellbore by a rotatable tubular member, the drilling assembly includes a drill bit at an end thereof that is rotatable by a drilling motor carried by the drilling assembly. A first adjustable stabilizer is disposed in the drilling assembly. A second stabilizer is spaced apart from the first adjustable stabilizer. A controller in the drilling assembly adjusts the position of a first center of the first adjustable stabilizer in the wellbore relative to a second center of the second stabilizer in the wellbore for controlling the trajectory of the wellbore. The position of the first center relative to the second center is determined at least in part upon a desired wellbore trajectory stored in the controller in the drilling assembly.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DETAILED DESCRIPTION OF THE PREFERRED EMBODIMENTS

The present invention provides a self-controlled drilling system and methods for efficiently and effectively drilling vertical, three dimensional curved and inclined straight sections of a wellbore. The operation of the drilling system may be, to any degree, preprogrammed for drilling one or more sections of the wellbore and/or controlled from the well surface or any other remote location.

Figure 1A:
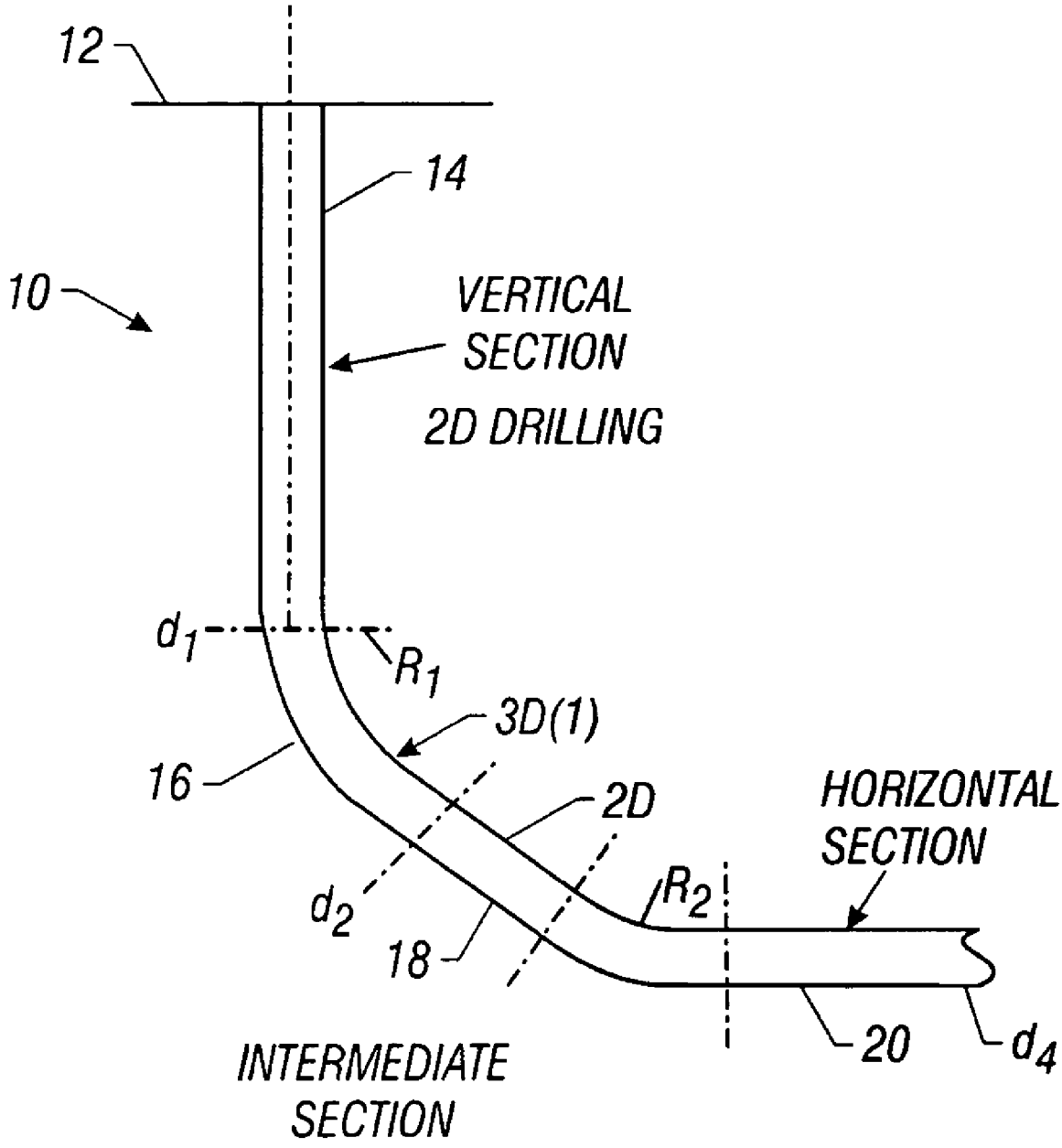
FIGS. 1A-1B show examples of well profiles that are contemplated to be drilled according to the systems of the present invention.
Figure 1B:
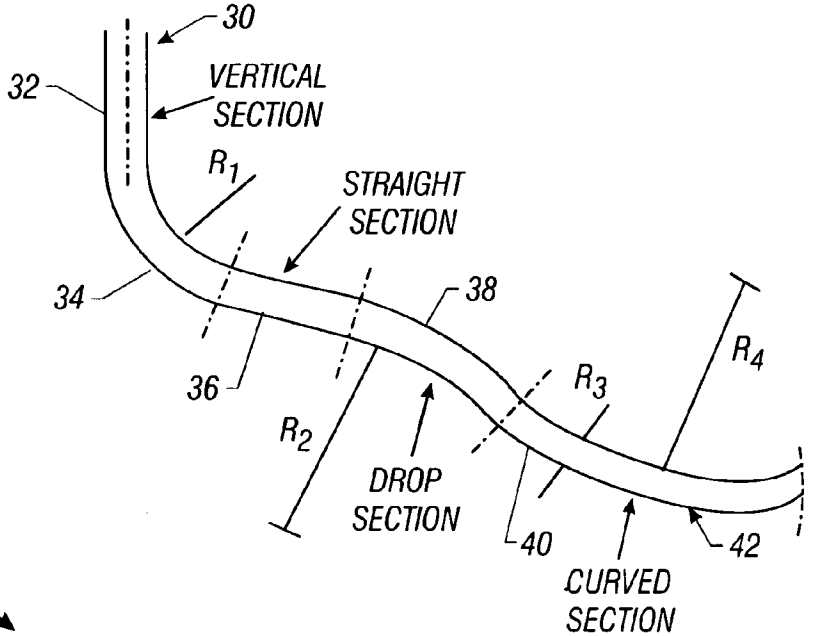

FIGS. 1A-1B show examples of certain wellbores which can be efficiently and effectively drilled by the drilling systems of the present invention. The drilling system is described in reference to FIGS. 2-3.

FIG. 1A shows a wellbore profile 10 that includes a vertical section 14 extending from the surface 12 to a depth d1. The wellbore 10 then has a first curved section 16 having a radius R1 and extends to the depth d2. The curved section 16 is followed by an intermediate section 18 which is a straight section that extends to the depth d3. The wellbore 10 then has a second curved section with a radius R2 that may be different (greater or lesser) from the first radius R1. The wellbore 10 is then shown to have a horizontal section 20 that extends to a depth d4 or beyond. The term "depth" as used herein means the reach of the well from the surface, and may not be the true vertical depth from the surface. The terms "3D" and "2D" refer to the three-dimensional or two-dimensional nature of the drilling geometry.

FIG. 1B shows a well profile 30, wherein the well has a vertical section 32 followed by a curved section 34 of radius R1', an inclined section 36 and then a second curved section 38 that is curved downward (dropping curved) with a radius R2'. The well then has a curved build-up section 40 with a radius R3' and section 42 with a radius R4'.

Figure 2:
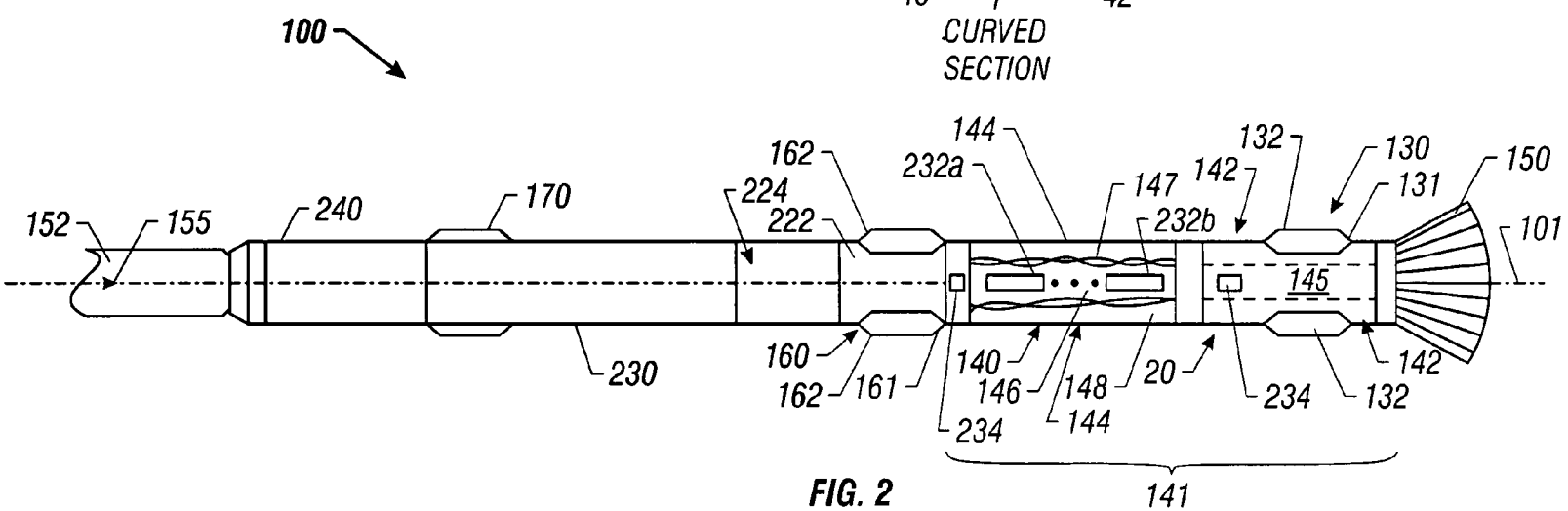
FIG. 2 shows a schematic of a drilling assembly made according to one embodiment of the present invention for drilling the wellbores of the type shown in FIGS. 1A-1B.

The number of the wellbores having well profiles of the type shown in FIGS. 1A-1B is expected to continue to increase. FIG. 2 shows a schematic diagram of a drilling assembly 100 according to one embodiment of the present invention for drilling the above-described wellbores. The drilling assembly 100 carries a drill bit 150 at its bottom or the downhole end for drilling the wellbore and is attached to a drill pipe 152 at its uphole or top end. A drilling fluid 155 is supplied under pressure from the surface through the drill pipe 152. A mud motor or drilling motor 140 above or uphole of the drill bit 150 includes a bearing section 142 and a power section 144. The drilling motor 140 is preferably a positive displacement motor, which is well known in the art. A turbine may also be used. The power section includes a rotor 146 disposed in a stator 148 forming progressive cavities 147 there between. Fluid 155 supplied under pressure to the motor 140 passes through the cavities 147 driving or rotating the rotor 146, the rotor 146 in turn is connected to the drill bit 150 via a drill shaft 145 in the bearing section 142 that rotates the drill bit 150. A positive displacement drilling motor is described in the patent application Ser. No. 09/015,848, assigned to the assignee of the application, the disclosure of which is incorporated herein by reference in its entirety. The bearing section 142 includes bearings which provide axial and radial stability to the drill shaft.

The bearing section or assembly 142 above the drill bit 150 carries a first steering device 130 which contains a number of expandable ribs 132 that are independently controlled to exert desired force on the wellbore inside and thus the drill bit 150 during drilling of the borehole. Each rib 132 can be adjusted to any position between a collapsed position, as shown in FIG. 2, and a fully extended position, extending outward or radially from the longitudinal axis 101 of the drilling assembly 100 to apply the desired force vector to the wellbore. A second steering device 160 is preferably disposed a suitable distance uphole of the first steering device 130. The spacing of the two rib devices will depend upon the particular design of the drilling assembly 100. The steering device 160 also includes a plurality of independently controlled ribs 162. The force applied to the ribs 162 may be different from that applied to the ribs 132. In one embodiment, the steering device 160 is disposed above the mud motor 140. A fixed stabilizer 170 is disposed uphole of the second steering device 160. In one embodiment, the stabilizer 170 is disposed near the upper end of the drilling assembly 100. In the drilling assembly configuration 100, the drill bit 150 may be rotated by the drilling motor 140 and/or by rotating the drill pipe 152. Thus, the drill pipe rotation may be superimposed on the drilling motor rotation for rotating the drill bit 150. The steering devices 130 and 160 each have at least three ribs for adequate control of the steering direction at each such device location. The ribs may be extended by any suitable method, such as a hydraulic system driven by the drilling motor that utilizes the drilling fluid 155 or by a hydraulic system that utilizes sealed fluid in the drilling assembly 100 or by an electro-hydraulic system wherein a motor drives the hydraulic system or an electro-mechanical system wherein a motor drives the ribs. Any suitable mechanism for operating the ribs may be utilized for the purpose of this invention. One or more sensors 131 may be provided to measure the displacement of and/or the force applied by each rib 132 while sensors 161 measure the displacement of and/or the force applied by the ribs 162. U.S. patent application Ser. No. 09/015,848 describes certain mechanisms for operating the ribs and determining the force applied by such ribs, which is incorporated herein by reference. U.S. Pat. No. 5,168,941 also discloses a method of operating expandable ribs, the disclosure of which is incorporated herein by reference.

A set of, preferably three, orthogonally mounted inclinometers 234 determines the inclination of the drilling assembly 100. The drilling assembly 100 preferably includes navigation devices 222, such as gyro devices, magnetometer, inclinometers or either suitable combinations, to provide information about parameters that may be utilized downhole or at the surface to control the drilling direction. Sensors 222 and 234 may be placed at any desired location in the drilling assembly 100. This allows for true navigation of the drilling assembly 100 while drilling. A number of additional sensors 232*a*-232*b* may be disposed in a motor assembly housing 141 or at any other suitable place in the assembly 100. The sensors 232*a*-232*b* may include a resistivity sensor, a gamma ray detector, and sensors for determining borehole parameters such as temperature and pressure, and drilling motor parameters such as the fluid flow rate through the drilling motor 140, pressure drop across the drilling motor 140, torque on the drilling motor 140 and the rotational speed (r.p.m.) of the motor 140.

The drilling assembly 100 may also include any number of additional sensors 224 known as the measurement-while-drilling devices or logging-while-drilling devices for determining various borehole and formation parameters or formation evaluation parameters, such as resistivity, porosity of the formations, density of the formation, and bed boundary information.

A controller 230 that includes one or more microprocessors or micro-controllers, memory devices and required electronic circuitry is provided in the drilling assembly. The controller receives the signals from the various downhole sensors, determines the values of the desired parameters based on the algorithms and models provided to the controller and in response thereto controls the various downhole devices, including the force vectors generated by the steering devices 130 and 160. The wellbore profile may be stored in the memory of the controller 230. The controller may be programmed to cause the drilling assembly to adjust the steering devices to drill the wellbore along the desired profile. Commands from the surface or a remote location may be provided to the controller 230 via a two-way telemetry 240. Data and signals from the controller 230 are transmitted to the surface via the telemetry 240.

Figure 3:
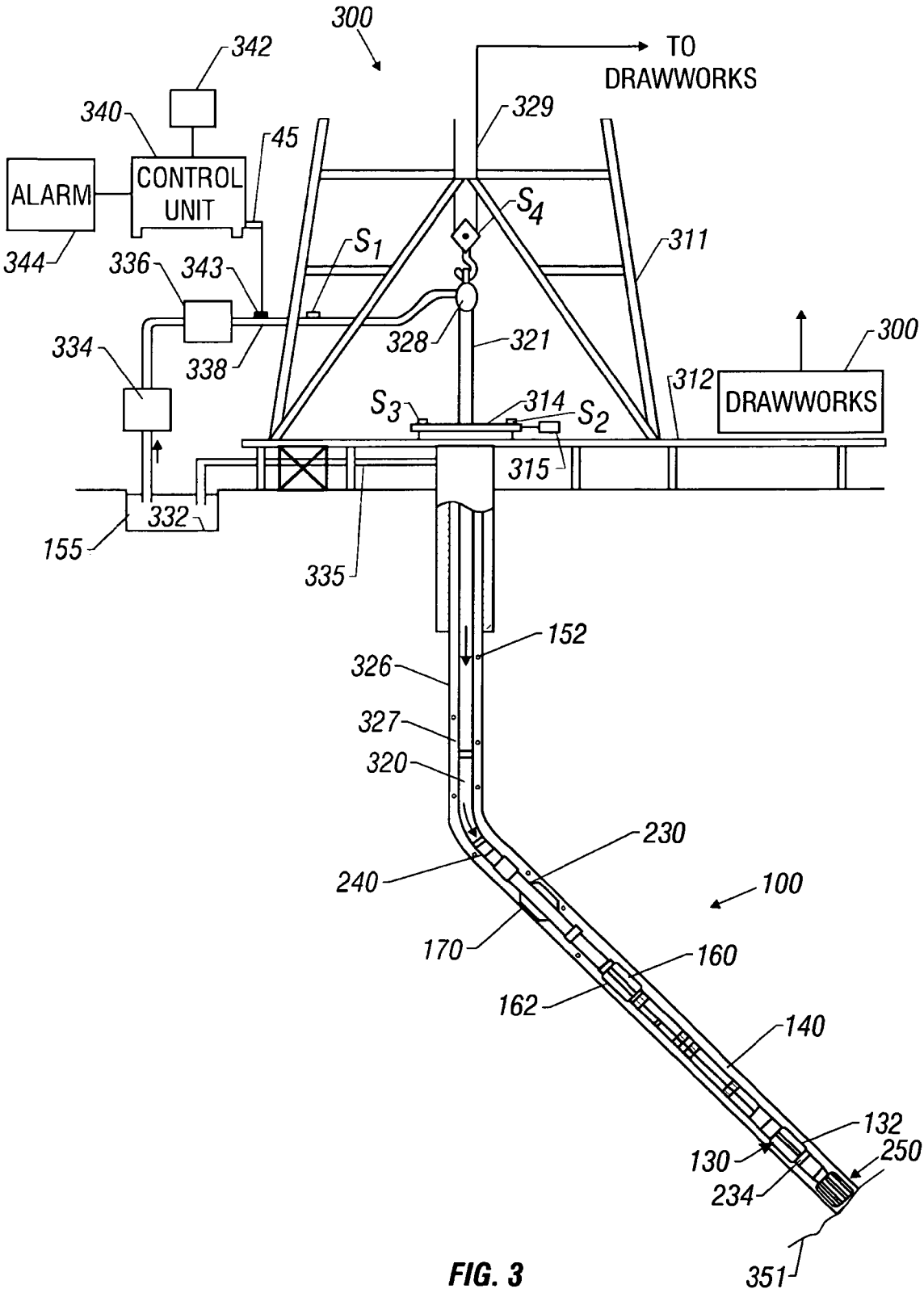
FIG. 3 is a schematic view of a drilling system utilizing the drilling assembly of FIG. 2 for drilling wellbores of the types shown in FIGS. 1A-1B.

FIG. 3 shows an embodiment of a land-based drilling system utilizing the drilling assembly 100 made according to the present invention to drill wellbores according to the present invention. These concepts and the methods are equally applicable to offshore drilling systems or systems utilizing different types of rigs. The system 300 shown in FIG. 3 has a drilling assembly 100 described above (FIG. 1) conveyed in a borehole 326. The drilling system 300 includes a derrick 311 erected on a floor 312 that supports a rotary table 314 which is rotated by a prime mover such as an electric motor 315 at a desired rotational speed. The drill string 320 includes the drill pipe 152 extending downward from the rotary table 314 into the borehole 326. The drill bit 150, attached to the drill string end, disintegrates the geological formations when it is rotated to drill the borehole 326. The drill string 320 is coupled to a drawworks 330 via a kelly joint 321, swivel 328 and line 329 through a pulley (not shown). During the drilling operation the drawworks 330 is operated to control the weight on bit, which is an important parameter that affects the rate of penetration. The operation of the drawworks 330 is well known in the art and is thus not described in detail herein.

During drilling operations, a suitable drilling fluid 155 from a mud pit (source) 332 is circulated under pressure through the drill string 320 by a mud pump 334. The drilling fluid 155 passes from the mud pump 334 into the drill string 320 via a desurger 336, fluid line 338 and the kelly joint 321. The drilling fluid 155 is discharged at the borehole bottom 351 through an opening in the drill bit 150. The drilling fluid 155 circulates uphole through the annular space 327 between the drill string 320 and the borehole 326 and returns to the mud pit 332 via a return line 335. A sensor $S_1$ preferably placed in the line 338 provides information about the fluid flow rate. A surface torque sensor $S_2$ and a sensor $S_3$ associated with the drill string 320 respectively provide information about the torque and the rotational speed of the drill string. Additionally, a sensor $S_4$ associated with line 329 is used to provide the hook load of the drill string 320.

In the present system, the drill bit 150 may be rotated by only rotating the mud motor 140 or the rotation of the drill pipe 152 may be superimposed on the mud motor rotation. Mud motor usually provides greater rpm than the drill pipe rotation. The rate of penetration (ROP) of the drill bit 150 into the borehole 326 for a given formation and a drilling assembly largely depends upon the weight on bit and the drill bit rpm.

A surface controller 340 receives signals from the downhole sensors and devices via a sensor 343 placed in the fluid line 338 and signals from sensors $S_1$, $S_2$, $S_3$, hook load sensor $S_4$ and any other sensors used in the system and processes such signals according to programmed instructions provided to the surface controller 340. The surface controller 340 displays desired drilling parameters and other information on a display/monitor 342 and is utilized by an operator to control the drilling operations. The surface controller 340 contains a computer, memory for storing data, recorder for recording data and other peripherals. The surface controller 340 processes data according to programmed instructions and responds to user commands entered through a suitable device, such as a keyboard or a touch screen. The controller 340 is preferably adapted to activate alarms 344 when certain unsafe or undesirable operating conditions occur.

The method of drilling wellbores with the system of the invention will now be described while referring to FIGS. 1A-3. For the purpose of this description, the drilling of the vertical hole sections, such as section 14 and other straight sections, such as sections 18 and 20 of FIG. 1A is also referred to as two-dimensional or "2D" holes. The drilling of the curved sections, such as section 16 of FIG. 1A and sections 34, 38, and 42 is referred to as three dimensional or "3D" drilling.

Referring to FIG. 1A, to form a vertical section, such as section 14 (FIG. 1A), the ribs 132 of the steering device 130 are adjusted to exert the same side force by each rib 132. However, the rib forces are preferably individually controlled to better maintain verticality. The ribs 162 of the second steering device 160 may also be adjusted in the same manner. The drilling is then performed by rotating the drill bit 150 by the drilling motor 140. If desired, the drill pipe 152 may also be rotated from the surface at any speed if the same force is applied to all the ribs or alternatively at relatively low speed if the ribs are individually controlled. The controller 230 determines from the inclination sensor measurements if the drill string 387 has deviated from the true vertical. The controller, in response to the extent of such deviation, adjusts the force vectors of one or more ribs of the steering devices 130 and/or 160 to cause the drill bit 150 to drill along the true vertical direction. This process continues until the drill bit 150 reaches the depth d1.

To initiate the drilling of the curved section 16, the drilling direction is changed to follow the curve with the radius R1. In one mode, a command signal is sent by the surface controller 340 to the downhole controller 230, which adjusts the force vectors of the ribs of one or both the steering devices 130 and 160 to cause the drill bit 150 to start drilling in the direction of the planned curve (path). The controller 230 continues to monitor the drilling direction from the inclination and navigation sensors in the drilling assembly 100 and in response thereto adjusts or manipulates the forces on the ribs 132 and/or 162 in a manner that causes the drill bit to drill along the curved section 16. The drilling of the 3-D section 16 is performed by the drilling motor 140. The drill string 387 is not rotated from the surface. In this mode, the drilling path 16 and algorithms respecting the adjustments of the rib force vectors are stored in the controller 230. In an alternative mode, the drilling direction and orientation measurements are telemetered to the surface and the surface controller 340 transmits the force vectors for the ribs, which are then set downhole. Thus, to drill a 3D section, the drilling is performed by the motor, while the rib force vectors are manipulated to cause the drill bit to drill along the curved section. The above described methods provide a self-controlled closed loop system for drilling both the 2D and 3D sections.

To drill an inclined section, such as section 18, the drilling may be accomplished in two different ways. In one method, the drill string is not rotated. The drilling is accomplished by manipulating the force on the ribs. Preferably both rib steering devices 130 and 160 are utilized. To drill the straight section 18, the force for the various ribs, depending upon the rib location in the wellbore, are calculated to account for the inclination and the gravity effect. The forces on the ribs are set to such predetermined values to drill the inclined section 18. Adjustments to the rib forces are made if the drilling deviates from the direction defined by the section 18. This may be done by transmitting command signals from the surface or according to the programs stored in the controller 230.

Alternatively, the drill bit rotation of the drilling motor is superimposed with the drill string rotation. The ribs of the steering device are kept at the same force. One or both steering devices 130 and 160 may be used. During the rotation of the drill string, the directional characteristics can be adjusted by the same adjustment of the radial displacement of the ribs or through the variation of the average force to the ribs, which is equivalent to a change of the stabilizer diameter. The use of both sets of the ribs enhances this capability and also allows a higher build-up rate. Rotating the drill string lowers the friction and provides better hole cleaning compared to the mode wherein the drill string is not rotated.

The force vectors for drilling a straight section in one mode of operation are computed at the surface. When the drill bit reaches the starting depth for such a section, the surface controller 340 sends command signals to the downhole controller 230, which sets all the ribs of the desired steering device to a predetermined force value. The drilling system then maintains the force vectors at the predetermined value. If the inclination of the drilling assembly differs from that of the desired inclination, the downhole controller adjusts the force vectors to cause the drilling to occur along the desired direction. Alternatively, command signals may be sent from the surface to adjust the force vectors. Horizontal sections, such as section 20, are drilled in the same manner as the straight inclined sections. The curved sections, such as section 38, are drilled in the 3D manner described earlier.

Figure 4A:
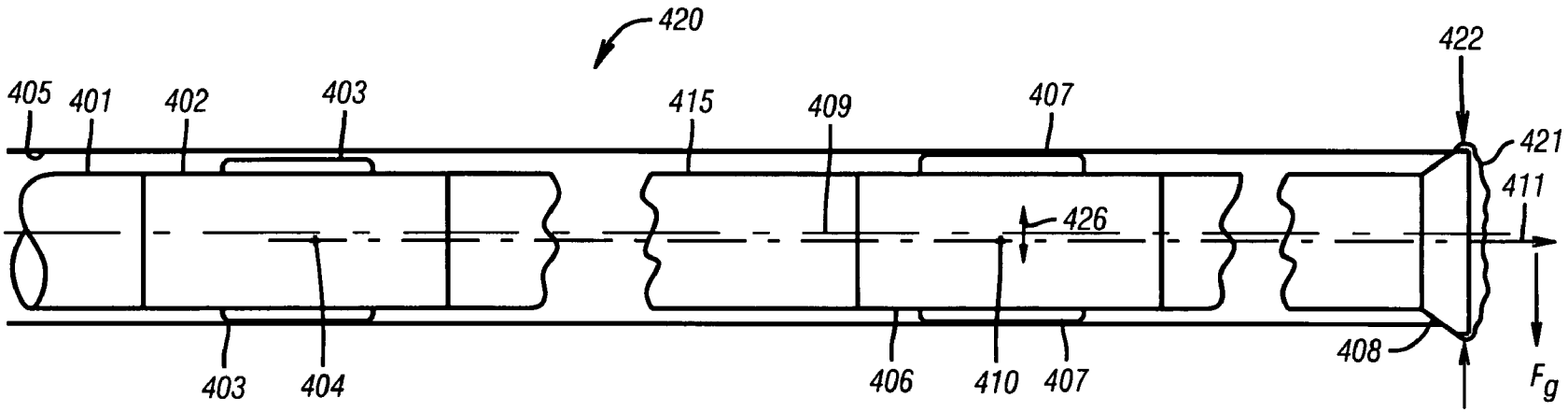
FIG. 4 is a schematic view of a drilling assembly made according to one embodiment of the present invention.
Figure 4B:
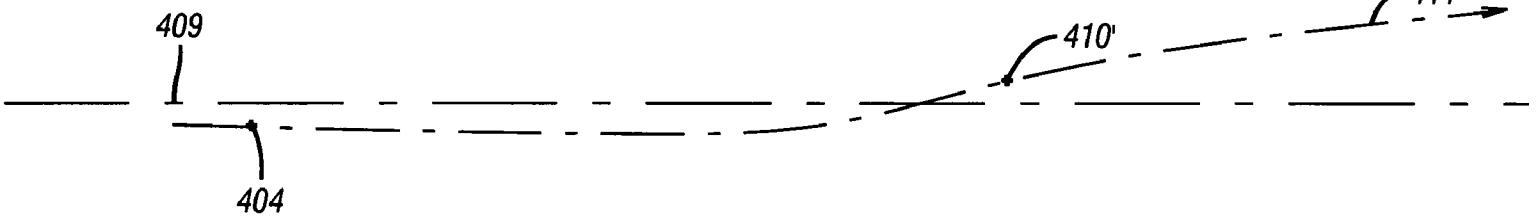
Figure 4C:
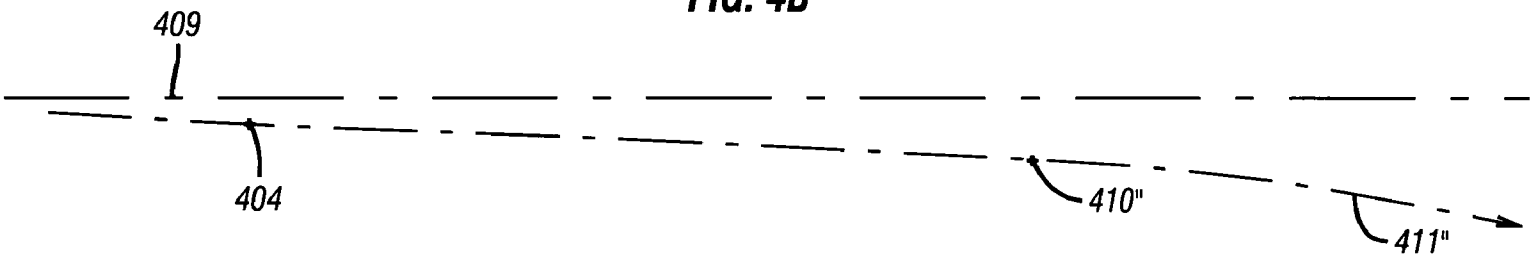
Figure 5A:
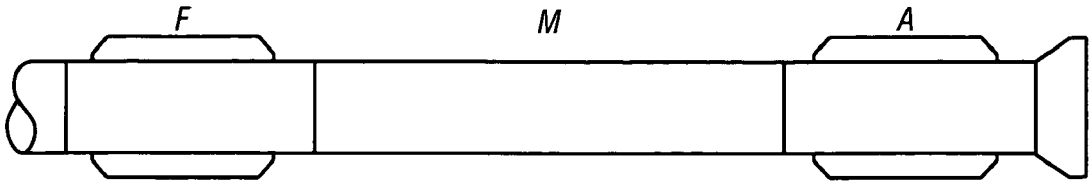
FIGS. 5A-D are schematic illustrations of a drilling assembly according to one embodiment of the present invention.
Figure 5B:
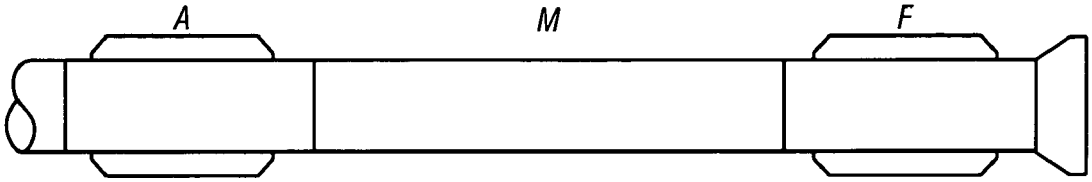
Figure 5C:
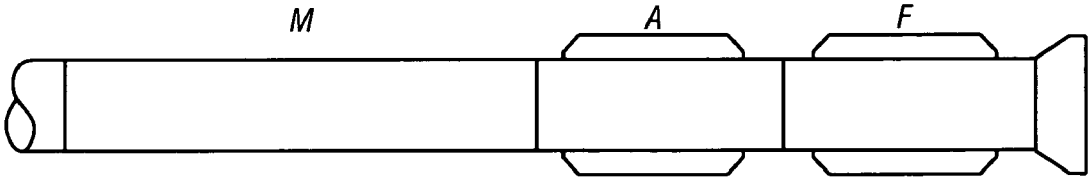
Figure 5D:
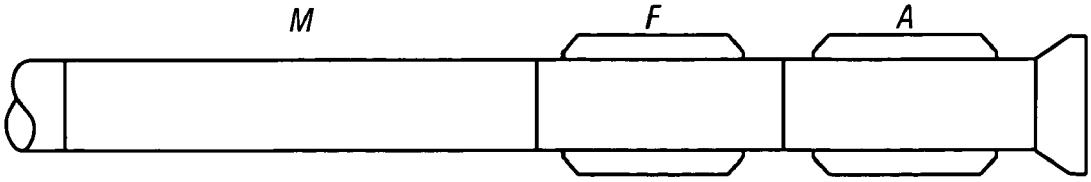

In another embodiment, shown in FIGS. 4A-C, bottomhole assembly (BHA) 420 is attached to a tubular string 401 and disposed in deviated wellbore 405. As shown, wellbore 405 is substantially horizontal, but may be any inclination, or deviation, from vertical. Wellbore 405 may also be three dimensional such that it extends at some angle from the plane of the paper as represented in FIGS. 4A-C. Wellbore 405 has centerline 409. Drill bit 408 is attached to the bottom of BHA 420 and acts to disintegrate formation 421 as it is rotated in contact with formation 421 by drilling motor 415. Drilling motor 415 may be a positive displacement motor or, alternatively a mud turbine, both of which are known in the art. The outer diameter 422 of drill bit 408 is called the gage diameter that essentially establishes the diameter of wellbore 405. The base diameter of the tubular members attached above drill bit 405 are typically smaller in diameter than the gage diameter.

Lower stabilizer 406 is part of bottomhole assembly 420 and is located a predetermined distance from bit 408. Lower stabilizer 406 has multiple ribs 407 that may be independently adjusted to extend out and contact the wall of wellbore 405 and exert a force on wall of wellbore 405. The ribs may be actuated by a hydraulic system, an electro-hydraulic system wherein a motor drives the hydraulic system and/or an electro-mechanical system wherein a motor drives the ribs using mechanical power transmission elements such as gears (not shown). Any suitable mechanism for operating the ribs may be utilized for the purpose of this invention. Lower stabilizer 406 also acts as a bearing housing for the drive shaft of drilling motor 415 such that the adjustable ribs only rotate when tubular string 401 rotates.

Upper stabilizer 402 is disposed in the BHA 420 a predetermined distance uphole from adjustable stabilizer 406. In one embodiment, upper stabilizer 402 is a fixed blade stabilizer having a plurality of blades. The blades may be straight or, alternatively, may be spiral in shape. The outer diameter of the blades 403 on upper stabilizer 402 is on the order of ¼ to ½ inch smaller than the gage diameter of drill bit 405. Alternatively, upper stabilizer 402 may be an adjustable stabilizer having a plurality of blades extendable a predetermined distance such that the outer diameter of the extended blades is undergage. The force of gravity $F_g$ acts to create a pendulum effect in BHA 420. The lack of wall contact on the top of upper stabilizer blades 403 provides a more limber assembly that may be more easily deflected than the BHA would be with an in-gage stabilizer at the same location as the undergage upper stabilizer 402. As shown in FIG. 4A, the gravitational force acts to force BHA 420 against the bottom side of wellbore 405, forcing contact on blades 403 and 407 of upper stabilizer 402 and lower stabilizer 406, respectively. At wall contact, the undergage diameter of stabilizer 402 places the center 404 of stabilizer 402 below the centerline 409 of wellbore 405. By adjusting the extension of ribs 407, the center 410 of lower stabilizer 406 may be positioned above, below, or coincident with center 404 as indicated by arrows 426. This variable positioning of the center 410 with respect to the center 404 allows the BHA 420 to bend and be directed along a predetermined path in a pendulum action known in the art. BHA 420 has a processor and sensors as described previously with respect to FIG. 2. The processor has a predetermined trajectory stored therein and uses sensors to determine the position of the BHA 420 with respect to the predetermined trajectory. The processor calculates deviations from the predetermined trajectory and adjusts the position of the center 410 to maintain the current trajectory 411 or to move the center to positions 410' and 410", for example, to create building or dropping trajectories as shown by paths 411' and 411" in FIGS. 4B and 4C, respectively.

As one skilled in the art will appreciate, various combinations of lower and upper adjustable stabilizer configurations are possible for steering the bottomhole assembly along the desired trajectory. Exemplary configurations are shown in FIG. 5A-D, where a M indicates a drilling motor, A indicates a stabilizer that is adjusted to control the wellbore path and F indicates a stabilizer whose blades are held in a fixed position during a particular directional section. Note that the F stabilizer may have mechanically fixed blades, such as welded on blades, or may have adjustable blades that are held at a predetermined position during the drilling of a particular section. Thus, both stabilizers may be adjustable stabilizers with one held at a predetermined extension to simulate a fixed stabilizer.

While the previous discussion was primarily directed to pendulum action due to gravity in substantially the vertical plane, one skilled in the art will appreciate that the system described is also capable of steering in the horizontal, or azimuth plane. In operation, without string rotation, multiple combinations of stabilizer extensions may be used to control the trajectory. The extension of one or more adjustable ribs enables the path to be steered in a 2 or 3 dimensional trajectory. For example, one stabilizer (upper or lower) may be pushed to the side by the extension of one or more ribs while the other stabilizer is has all of its ribs equally extended at a predetermined position. The predetermined position may be full gage or under gage. In another example, both stabilizers may have there ribs extended to simulate two predetermined diameters that in effect result in a full gage/underage combination to enable the pendulum control described previously. This under gage/full gage configuration is also usable with string rotation. In yet another example, both stabilizers may be pushed to the side by having at least one rib of each stabilizer radially extended.

Thus, the present invention provides an adjustable pendulum drilling system which can be used to drill a curved hole and then a straight inclined and/or horizontal section. The curved section can be a build-up angle section or drop angle section. The system includes a full directional sensor package and a control unit along with control models or algorithms. These algorithms include downhole adjustable build-up rates needed and the automated generation and maintenance of the force vectors and/or rib displacements. This eliminates the need for tedious manual weight-on-bit and tool face control commonly used. The true navigation becomes possible with the integration of gyro systems. This automated system substantially reduces the manual intervention, leaving the need to only supervise the drilling process.

The system of the present invention which utilizes the motor with the ribs that automatically adjusts side forces, pendulum effects and the steering direction closes the gap that exists between the conventional steerable motors with a fixed bend and the steering-while-rotating systems. Because the system of the present invention allows fine tuning the directional capability while drilling, and because of no need for time consuming tool face orientations, such systems often have significant benefits over the steerable motor systems. The systems of the present invention result in faster drilling and can reach targets in greater lateral reach.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

What is claimed is:

1. A method of drilling a wellbore, the method comprising:

(a) conveying a drilling assembly in the wellbore, said drilling assembly including a first adjustable stabilizer having a first plurality of independently adjustable ribs for applying force to the wellbore and a second stabilizer including a plurality of ribs having an undergage outer diameter;

(b) engaging a wellbore wall using at least one of the plurality of ribs of the second stabilizer, said wellbore having a centerline along the drilling assembly; and (c) controlling a direction of drilling by:

(i) applying a force on the wellbore using the first stabilizer to adjust a position of a first center of said first adjustable stabilizer in the wellbore relative to a second center of said second stabilizer and with respect to the centerline of the wellbore to drill the wellbore along a desired wellbore trajectory; and (ii) independently controlling each of the first plurality of independently adjustable ribs.

2. The method of claim 1, wherein said second stabilizer includes at least one independently adjustable rib.

3. The method of claim 1, wherein the second stabilizer is a fixed blade stabilizer.

4. The method of claim 2 further comprising applying a force on the wellbore by each of the ribs in the second plurality of ribs to adjust the positions of the first center and the second center with respect to the center line of the wellbore.

5. The method of claim 1, further comprising causing no wall contact on an upper portion of the second stabilizer and causing wall contact at a lower portion of the second stabilizer.

6. The method of claim 1 further comprising measuring inclination of one of (i) the drilling assembly or (ii) said wellbore.

7. The method of claim 1 further comprising drilling said wellbore along a predetermined well path.

8. The method of claim 1 further comprising determining a parameter indicative of direction of drilling of said wellbore.

9. The method of claim 8 further comprising altering direction of drilling of said wellbore if said parameter is outside a selected limit.

10. The method of claim 2 further comprising altering said drilling direction by altering the force applied by at least one rib in said first or second stabilizer.

11. The method of claim 2 further comprising adjusting the force applied by one of the first and second stabilizers based at least in part on a pre-selected wellbore trajectory.

12. A system of controlling a trajectory of a wellbore, the system comprising:

a. a drilling assembly deployed in said wellbore by a rotatable tubular member, said drilling assembly including a drill bit at an end thereof that is rotatable by a drilling motor carried by the drilling assembly, said wellbore having a center line along the drilling assembly;

b. a first adjustable stabilizer disposed in said drilling assembly, having a first set of ribs spaced around said first adjustable stabilizer, with each rib configured to be independently radially extendable and independently controllable;

c. a second stabilizer including a plurality of ribs having an undergage outer diameter and being spaced apart from said first adjustable stabilizer; and d. a controller in the drilling assembly programmed to control a direction of drilling by independently controlling each rib of the first adjustable stabilizers and adjusting a position of a first center of the first adjustable stabilizer in the wellbore relative to a second center of the second stabilizer in the wellbore while the second stabilizer engages a wellbore wall, wherein the position of the first center relative to the second center is determined at least in part based upon a desired wellbore trajectory stored in the controller in a memory associated with the drilling assembly.

13. The system of claim 12, wherein the second stabilizer comprises a fixed blade stabilizer.

14. The system of claim 12, wherein the second stabilizer includes at least one rib that is independently radially extendable.

15. The system of claim 12, wherein the second stabilizer has an under-gage outer diameter selected to provide no wall contact on an upper portion of the second stabilizer and wall contact at a lower portion of the second stabilizer.

16. The system of claim 12, further comprising a sensor for measuring inclination of at least one of (i) the drilling assembly and (ii) said wellbore.

17. The system of claim 12, further comprising at least one sensor for determining a direction of the wellbore.

18. The system of claim 17, wherein said at least one of said first set of ribs is controlled to alter said drilling direction by altering a force applied by at least one rib in said first set of ribs.

19. The system of claim 14, wherein the position of the second stabilizer is adjusted by changing the extension of the at least one independently radially extendable rib.

20. A method of controlling drilling direction in a wellbore, the method comprising:

(a) drilling the wellbore with a drilling assembly including a drill bit rotated by a drilling motor, a first adjustable stabilizer and a second stabilizer having an undergage outer diameter; and (b) controlling a drilling direction of the drill bit by:

(i) adjusting a position of a first center of said first adjustable stabilizer relative to a second center of said second stabilizer and with respect to a wellbore centerline along the drilling assembly while at least a portion of the second stabilizer engages a wellbore wall; and (ii) independently controlling each of a first plurality of independently adjustable ribs associated with one of (i) the first adjustable stabilizer and (ii) the second stabilizer.

21. The method of claim 20 further comprising superimposing a drill string rotation on the drill bit.

22. The method of claim 20 further comprising positioning the center of the second stabilizer eccentric of a centerline of the wellbore such that gravity causes a pendulum effect for a drill string coupled to the drill bit.

23. The method of claim 20 further comprising determining a deviation between a measured trajectory and a predetermined direction; and adjusting the center of the first adjustable stabilizer relative to the center of the second stabilizer in response to the measured deviation.

24. The method of claim 20 further comprising fixing a diameter of the second stabilizer while drilling a deviated section of the wellbore.

25. The method of claim 20, wherein the second stabilizer includes at least one independently controllable rib.

26. The method of claim 1, wherein the drilling assembly includes a drill bit that is rotated by a drilling motor and wherein the first stabilizer is on a portion of the drilling motor.

27. The method of claim 1, further comprising: individually adjusting a force vector of each of the first plurality of independently adjustable ribs.

* * * * *

UNITED STATES PATENT AND TRADEMARK OFFICE

CERTIFICATE OF CORRECTION

PATENT NO. : 7,413,032 B2
APPLICATION NO. : 10/758309
DATED : August 19, 2008
INVENTOR(S) : Volker Krueger It is certified that error appears in the above-identified patent and that said Letters Patent is hereby corrected as shown below:

Column 12, line 13, delete “said at least one of said” and insert --the at least one of the--; and Column 12, line 47, delete “measured” and insert --determined--.

Signed and Sealed this

Eleventh Day of November, 2008

JON W. DUDAS
*Director of the United States Patent and Trademark Office*